US009237642B2

(12) United States Patent
Kleeven

(10) Patent No.: US 9,237,642 B2
(45) Date of Patent: Jan. 12, 2016

(54) METHODS FOR ADJUSTING THE POSITION OF A MAIN COIL IN A CYCLOTRON

(71) Applicant: Ion Beam Applications, S.A., Louvain-La-Neuve (BE)

(72) Inventor: Willem Jan G. Kleeven, Pellenberg (BE)

(73) Assignee: Ion Beam Applications, S.A., Louvain-la-Neuve (BE)

( * ) Notice: Subject to any disclaimer, the term of this patent is extended or adjusted under 35 U.S.C. 154(b) by 90 days.

(21) Appl. No.: 14/292,887

(22) Filed: May 31, 2014

(65) Prior Publication Data

US 2014/0354190 A1 Dec. 4, 2014

(30) Foreign Application Priority Data

Jun. 4, 2013 (EP) ..... 13170532

(51) Int. Cl.
*H05H 13/00* (2006.01)

(52) U.S. Cl.
CPC ..... *H05H 13/005* (2013.01)

(58) Field of Classification Search
CPC ..... H05H 13/00; H05H 13/04; H05H 13/005
USPC ..... 315/500–507; 313/62
See application file for complete search history.

(56) References Cited

U.S. PATENT DOCUMENTS

2013/0328475 A1* 12/2013 Hashimoto ..... H05H 13/005 313/47
2014/0139096 A1* 5/2014 Mitsumoto ..... H05H 13/005 313/62

OTHER PUBLICATIONS

European Search Report dated Oct. 21, 2013.
M.K. Dey et al.: "Coil Centering of the Kolkata Superconducting Cyclotron Magnet", Cyclotrons and Their Applications 2007, 18th International Conference, 2007, pp. 438-440.
R.K. Bhandari et al.: "Commissioning of the Main Magnet of Kolkata K-500 Superconducting Cyclotron", Proceedings of PAC2005, 2005, pp. 2765-2767.
A. Roy et al.: "Median Plane Magnetic Field Mapping for Superconducting Cyclotron (SCC) in VECC", Proceedings of APAC 2007, 2007, pp. 652-654.
J. Kim: "Effects of Vertical Misalignment of Superconducting Coils in Cyclotrons", Cyclotrons and Their Applications 16th International Conference, 2001, pp. 405-407.

* cited by examiner

*Primary Examiner* — Daniel D Chang
(74) *Attorney, Agent, or Firm* — Lowenstein Sandler LLP

(57) ABSTRACT

The invention concerns methods for adjusting the position of a main coil assembly in a cyclotron with respect to a median plane (M) and/or to a central axis (Z) of the cyclotron.

15 Claims, 3 Drawing Sheets

METHODS FOR ADJUSTING THE POSITION OF A MAIN COIL IN A CYCLOTRON

CROSS-REFERENCE TO RELATED APPLICATIONS

This application claims the benefit of priority of European Application No. 13170532.9, filed Jun. 4, 2013, the disclosure of which is hereby incorporated by reference herein in its entirety.

FIELD OF THE INVENTION

The invention relates to the field of cyclotrons and to methods for adjusting the position within the cyclotron of a main magnetic field generating coil assembly.

BACKGROUND OF THE INVENTION

A cyclotron is a type of particle accelerators which comprise a vacuum enclosure in which charged particles are accelerated outwards from a central axis and along a spiral trajectory in an acceleration region of a median plane of the cyclotron under the combined effect of a high frequency electric field ($\vec{E}$) and of a main magnetic field ($\vec{B}$), the latter being generated by excitation of a main coil assembly.

It is known that the main magnetic field ($\vec{B}$) has to be oriented as perpendicular as possible to the median plane in said particle acceleration region, in order to keep the charged particles within their desired trajectory. It is further also known that the main magnetic field ($\vec{B}$) has to be centred as well as can be with respect to the central axis of the cyclotron, said central axis being perpendicular to the median plane.

There is thus a need to position the main coil assembly as accurately as possible with respect to said median plane and with respect to said central axis in order to obtain the desired orientation and symmetry of the main magnetic field ($\vec{B}$) in the particle acceleration region.

This need is of particular importance in case the direction and amplitude of the main magnetic field ($\vec{B}$) in the particle acceleration region is dominated by the orientation and position of the main coil assembly, such as for example when main coil assembly comprises superconducting coils which are used to produce a magnetic field exceeding the saturation state of a ferromagnetic core which they surround or when no ferromagnetic core is used.

A method for adjusting the position of a superconducting main coil in a cyclotron is known from Dey et al. ("Coil centering of the Kolkata superconducting cyclotron magnet"; Cyclotrons and Their Applications 2007, Eighteenth International Conference). They propose to measure the forces in a plurality of support links supporting the excited main coil assembly in a hanging fashion into the cyclotron, and to centre the main coil assembly by adjusting the length of these support links in function of a lowest force criterion. After getting a minimum force position of the main coil assembly, further adjustment of the position of the main coil assembly is performed by measuring the main magnetic field ($\vec{B}$) in the particle acceleration region and by minimizing the first harmonic component of this main magnetic field.

A problem with such a method is that any asymmetry in the magnetic circuit will negatively influence the accuracy of the method. Another problem is that it requires sensors and related equipment for measuring the forces in all the support links, which adds complexity and cost. Yet another problem is that it is an indirect method, which may also negatively influence its accuracy.

Another known method consists in measuring the efficiency of the cyclotron when in operation and to adjust the position of the main coil assembly in order to maximize the efficiency. Indeed, when the main coil assembly is misaligned, charged particles will move out of their desired trajectory and will be lost, so that the efficiency of the cyclotron will drop and vice-versa. A problem with this method is that the efficiency may be influenced by other parameters than the position of the main coil assembly, so that this method is not accurate enough.

Although these know methods do work, there is room for improvement, particularly as far as the accuracy of the positioning of the main coil assembly with respect to the median plane is concerned.

SUMMARY OF THE INVENTION

It is an object of the invention to provide methods for adjusting the position of a main coil assembly in a cyclotron with respect to the median plane and/or with respect to the central axis of the cyclotron, with better accuracy than with the existing methods.

The invention is defined by the independent claims. The dependent claims define advantageous embodiments.

The invention concerns any kind of cyclotron, including isochronous cyclotrons, synchrocyclotrons, etc. Preferably, the invention concerns a cyclotron whose main coil assembly has a circular cross-section.

According to the invention, there is provided a first method for adjusting the position of a main coil assembly in a cyclotron with respect to a reference plane, said method comprising the steps of :

a) providing a cyclotron designed for accelerating charged particles in a particle acceleration region of a median plane of the cyclotron, said cyclotron comprising a main coil assembly designed to generate a main magnetic field for bending a trajectory of the charged particles in the acceleration region and first positioning means which are adapted to adjust a position of said main coil assembly with respect to said median plane, b) applying power to the main coil assembly, c) determining a first position, at a first azimuth in the median plane and outside the particle acceleration region, at which the magnitude of an axial component of the main magnetic field perpendicular to the median plane is smaller than 25% (preferably smaller than 10%, more preferably smaller than 5%, even more preferably smaller than 1%) of a maximum magnitude of the axial component of the main magnetic field at said first azimuth, d) placing a magnetic field sensor at the first position and orienting it in order to detect a radial component of the main magnetic field parallel to the median plane, e) measuring the magnitude of said radial component of the main magnetic field with the magnetic field sensor, thereby yielding a first measured value Bh1 f) adjusting the position of the main coil assembly with respect to the median plane by using the first positioning means so as to reduce the absolute value of Bh1.

With this method, a magnetic field sensor is thus placed at a first position in the median plane where the magnitude of the axial component of the main magnetic field, i.e. the component which is perpendicular to the median plane, is quite small compared to the maximum magnitude of the axial component of the main magnetic field. The first position is therefore located close to a radial position where the magnitude of the axial component of the main magnetic field crosses zero. Preferably, the first position is a radial position where the magnitude of the axial component of the main magnetic equals zero (plus or minus a measurement accuracy of course).

When placed at said first position, the magnetic field sensor is oriented in order to detect the magnitude of the radial component of the main magnetic field, i.e. the component which is parallel to the median plane.

By then measuring the magnitude of the radial component of the magnetic field with said sensor at said first position and with said orientation and by adjusting the position of the main coil assembly so as to reduce the measured magnitude (in absolute value), one will consequently also reduce the magnitude of the radial component of the main magnetic field in the particle acceleration region, i.e. the component which is parallel to the median plane in said region, and hence obtain a main magnetic field in the particle acceleration region which is more perpendicular to the median plane.

Furthermore, because of the large ratio between the magnitude of the radial component and the magnitude of the axial component of the main magnetic field at the first position compared to the same ratio in the acceleration region, the accuracy of the method will be less influenced by a possible misalignment of the magnetic field sensor than if said sensor were placed in the acceleration region, thereby yielding a better accuracy in the positioning of the main coil assembly.

Preferably, the aforementioned steps e) and f) are repeated until the absolute value of Bh1 reaches a minimum. When this minimum is reached, the main coil assembly will be almost optimally positioned with respect to the first position.

The determination of the first position can be done by modelling and simulation or by magnetic field measurements.

Preferably, the first position is determined by magnetic field measurements in the median plane and outside the particle acceleration region as defined in claim 3. This is indeed an easy and reliable way to determine the first position, all the more so because it allows for example the use of the same magnetic field sensor and the same measuring equipment for both measurements. It is to be noted that, for determining the first position, the orientation of the magnetic field sensor with respect to the median plane does not need to be extremely accurate since the purpose is only to find a radial region in the median plane where the magnitude of the axial component of the main magnetic field is small with respect to the magnitude of an axial component of the main magnetic field in the acceleration region for instance.

More preferably, the steps c), d), e) and f) are further performed at a second azimuth in the median plane, different from the first azimuth. The main coil assembly will then be better positioned with respect to at least two different first positions/points of the median plane, thereby achieving a better alignment of the main magnetic field at least in a central part of the particle acceleration region (less tilting and/or better symmetry with respect to the median plane). Even more preferably, the steps c), d), e) and f) are further performed at a third azimuth in the median plane, different from the first and from the second azimuths.

According to the invention, there is also provided a second method, for adjusting a lateral position of a main coil assembly in a cyclotron with respect to a reference axis, said method comprising the steps of:

a) providing a cyclotron designed for accelerating charged particles in a particle acceleration region of a median plane of the cyclotron, a central axis of the cyclotron being perpendicular to said median plane, said cyclotron comprising a main coil assembly designed to generate a main magnetic field for bending a trajectory of the charged particles in the acceleration region and second positioning means which are adapted to adjust a lateral position of said main coil assembly with respect to said central axis, b) applying power to the main coil assembly, c) selecting a first plane parallel to the median plane and considering, in said first plane, a polar coordinate system having as origin the intersection between the central axis and the first plane, d) determining, in said first plane and at a first azimuth, a first radius (R1*a*) outside the acceleration region and at which an axial component of the main magnetic field perpendicular to the median plane has a first magnitude (Bv1*a*) comprised between a minimum and a maximum magnitude of said axial component of the main magnetic field at said first azimuth, e) repeating step d) at a second azimuth and at a third azimuth, thereby yielding respectively a second radius (R2*a*) and a third radius (R3*a*) corresponding to respectively to a second magnitude (Bv2*a*) and a third magnitude (Bv3*a*) of the axial component of the main magnetic field, f) adjusting the lateral position of the main coil assembly with respect to the central axis by using the second positioning means and in function of the values of R1*a*, R2*a*, R3*a*, Bv1*a*, Bv2*a*, Bv3*a*.

As with the first method, this second method thus also proposes to adjust the position of the main coil assembly in function of magnetic field amplitudes existing at radial positions which are outside the particle acceleration region, more particularly in radial regions where the magnitude of the axial component of the main magnetic field, i.e. the component which is perpendicular to the median plane, varies quite strongly with the radial position, thereby obtaining a good sensitivity and improving the accuracy in the lateral positioning of the main coil assembly with respect to the central axis.

BRIEF DESCRIPTION OF THE DRAWINGS

These and further aspects of the invention will be explained in greater detail by way of example and with reference to the accompanying drawings in which.

The drawings of the figures are neither drawn to scale nor proportioned. Generally, identical components are denoted by the same reference numerals in the figures.

DETAILED DESCRIPTION OF EMBODIMENTS OF THE INVENTION

Figure 1:
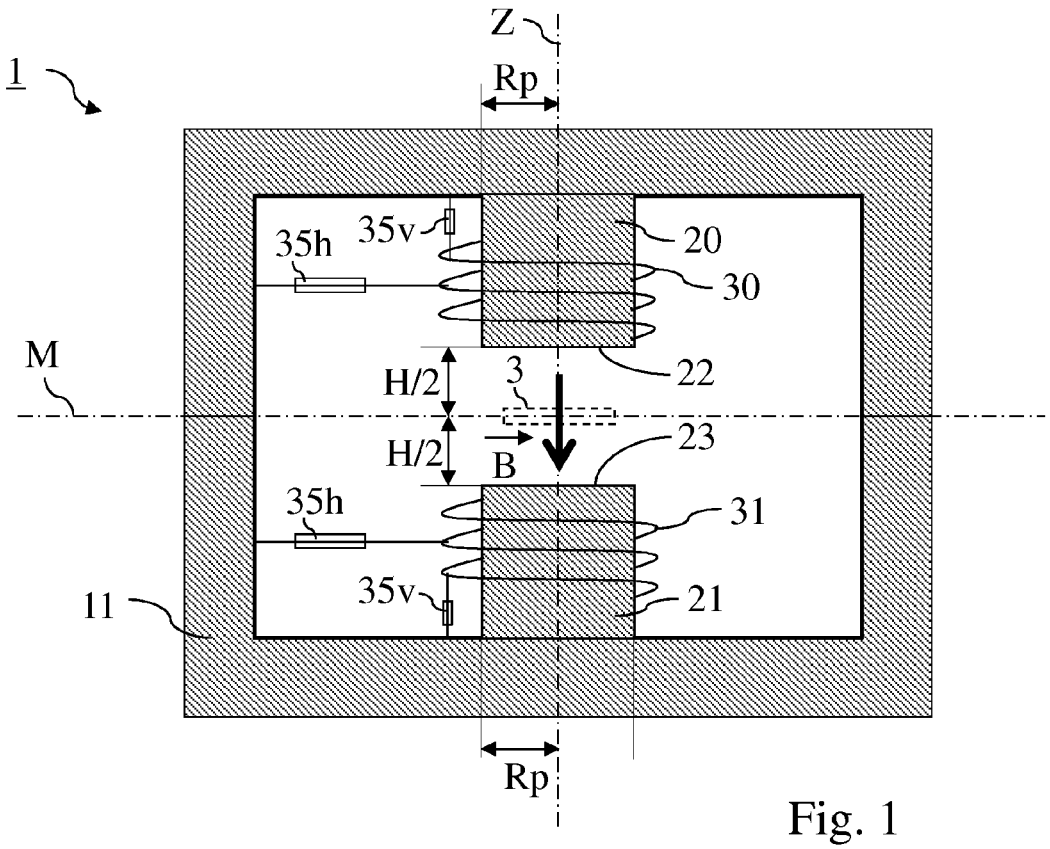
FIG. 1 schematically shows the main magnetic parts of an exemplary cyclotron.

FIG. 1 schematically shows the main magnetic parts of an exemplary cyclotron (1), which include a main magnetic circuit comprising a main magnetic core (11) presenting two protruding poles (20, 21), whose respective distal faces (22, 23) are facing each other, and an outer return path for the magnetic field. Although not shown on this figure, the gap between those two distal faces is equipped with acceleration electrodes (sometimes called "dees") which are designed to generate an electric field which, when in operation, will accelerate the charged particles in a particle acceleration region (3) around a median plane (M) of the cyclotron (1) until said particles are extracted from the cyclotron (1) for further use.

A main coil assembly (30, 31) is mounted around the two poles (20, 21) and is adapted, when exited, to generate a main magnetic field ($\vec{B}$) in the particle acceleration region (3). In order to keep the charged particles in a desired trajectory in the acceleration region (3), this main magnetic field ($\vec{B}$) should be substantially perpendicular to the median plane (M) of the cyclotron (1) and correctly centred on the central axis (Z) of the cyclotron (1).

It is to be noted that, in the context of the present application, the terms "main coil assembly" designate any arrangement of single or multiple coils which may be mechanically and/or electrically interlinked, or mechanically and/or electrically independent from each other, and whose function is to generate the main magnetic field ($\vec{B}$) in the cyclotron (1) when they are excited. In the present exemplary embodiments, the main coil assembly (30, 31) comprises two mechanically interlinked coils such as two coils mounted on a single bobbin for example, but any other configuration may be appropriate as well.

It is also to be noted that many other magnetic circuit configurations fall within the scope of the present invention. Nonetheless, the methods of the present invention preferably apply to cyclotrons whose main magnetic circuit is configured in such a way that, when in operation, the orientation and magnitude of the main magnetic field ($\vec{B}$) in the particle acceleration region (3) is dominated by the orientation and position of the main coil assembly (30, 31). This is for example the case when superconducting coils are used and produce a main magnetic field exceeding a saturation state of a magnetic core which they surround, or when no magnetic core is used.

The cyclotron (1) is further provided with first—(35*v*) and/or second (35*h*) positioning means (35*v*, 35*h*) which are adapted to adjust a position of the main coil assembly (30, 31) with respect to the median plane (M) and/or to a central axis (Z) of the cyclotron (1). Such positioning means may for example comprise a plurality of length-adjustable support links which directly or indirectly link the main coil assembly (30, 31) mechanically to a fixed part of the cyclotron (1) such as to the main magnetic core (11) for example. One can for example use a set of three radial support links (35*h*) and/or six axial support links (35*v*) as described by Dey et al. in "Coil centering of the Kolkata superconducting cyclotron magnet" (Cyclotrons and Their Applications 2007, Eighteenth International Conference), which is incorporated herein by reference, so that the position of the main coil assembly (30, 31) can be adjusted axially and/or radially with respect to the median plane (M) and/or to a central axis (Z) of the cyclotron (1).

Figure 2:
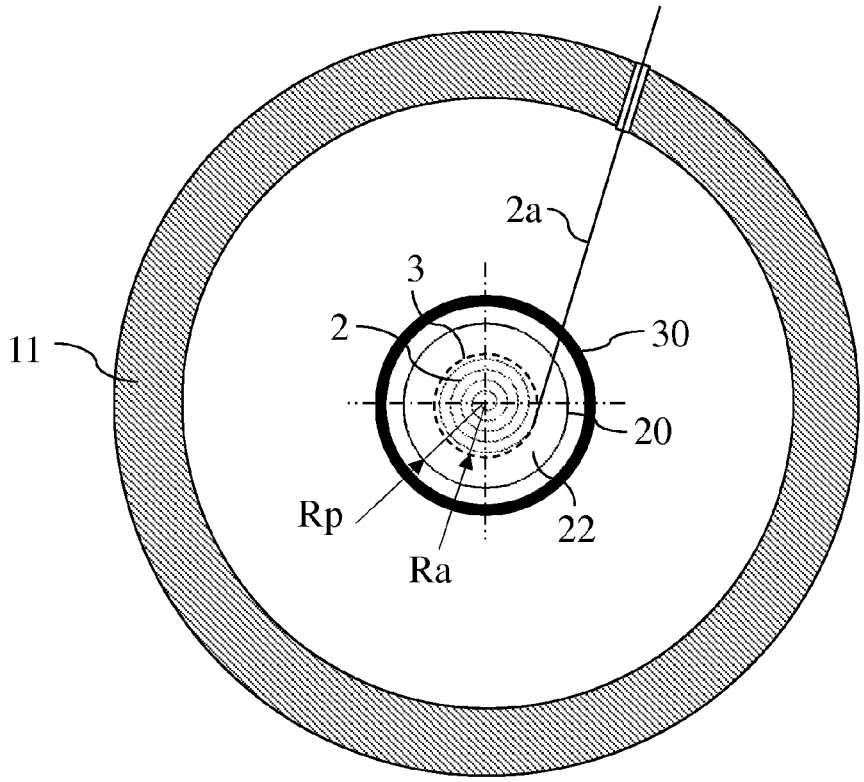
FIG. 2 schematically shows a cross section of the cyclotron of FIG. 1 according to its median plane as well as a nominal trajectory of the charged particles when the cyclotron is in operation.

FIG. 2 schematically shows a cross section of the cyclotron (1) of FIG. 1 according to its median plane (M), as well as a nominal spiral trajectory of the charged particles when the cyclotron (1) is in operation, and a corresponding particle acceleration region (3) having an outer radius (Ra) (sometimes also called the "extraction radius") which is generally smaller than the radius (Rp) of the poles. The rectilinear tail (2*a*) of the spiral trajectory corresponds to the trajectory of charged particles which are extracted from the acceleration region (3) for further use outside the cyclotron (1).

A central axis (Z) of the cyclotron (1) is an axis perpendicular to the median plane (M) and passing through a centre of the nominal trajectory of the charged particles (the centre of the spiral shown in FIG. 2).

Figure 3:
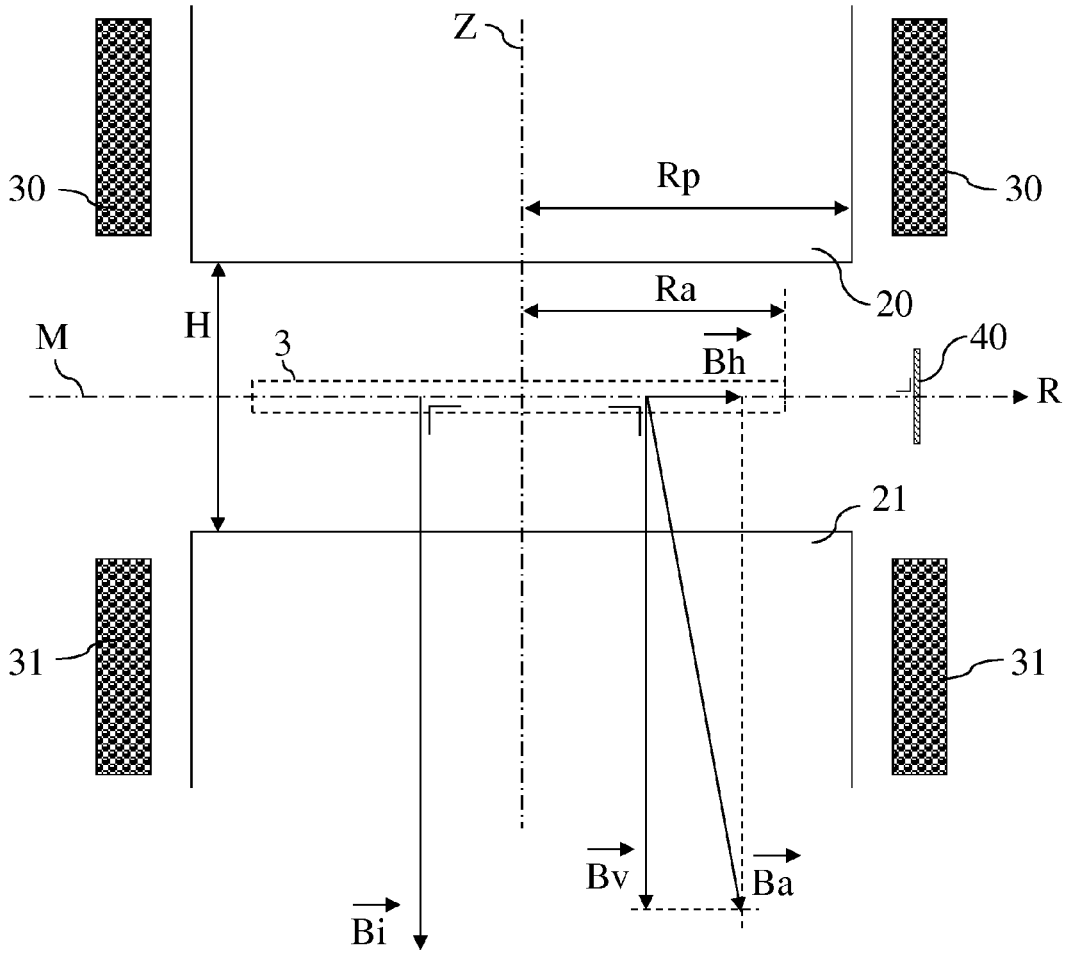
FIG. 3 schematically shows a longitudinal section of a central part of the cyclotron of FIG. 1.

FIG. 3 schematically shows a central portion of the cyclotron (1) of FIG. 1, with the two poles (20, 21) surrounded by the main coil assembly (30, 31). In this example, the main coil assembly (30, 31) comprises two coils disposed on opposite sides of the median plane (M). Ideally, the main coil assembly (30, 31) should generate a main magnetic field ($\vec{Bt}$) which, at least in the acceleration region, is perpendicular to the median plane (M) and centred with respect to the central axis (Z). When the main coil assembly (30, 31) is mounted in the cyclotron (1) and attached to it by means of for example the aforementioned support links (35*v*, 35*h*), the main coil assembly (30, 31) is firstly aligned as well as can be with respect to the median plane (M) and to the central axis (Z), for example by using known distance measurement tools. As shown on FIG. 3, in case of incorrect alignment of the main coil assembly (30, 31) with respect to the median plane (M), it will apply a main magnetic field ($\vec{Ba}$) which is not strictly perpendicular to the median plane (M), and which will therefore present an axial component ($\vec{Bv}$) which is perpendicular to the median plane (M) and a non-zero radial component ($\vec{Bh}$) which is parallel to the median plane (M).

These parts of a cyclotron as well as their operation being well known from the prior art, they will not be described further in the present context.

Attention will now be drawn to the two methods according to the invention.

FIRST METHOD

Figure 4:
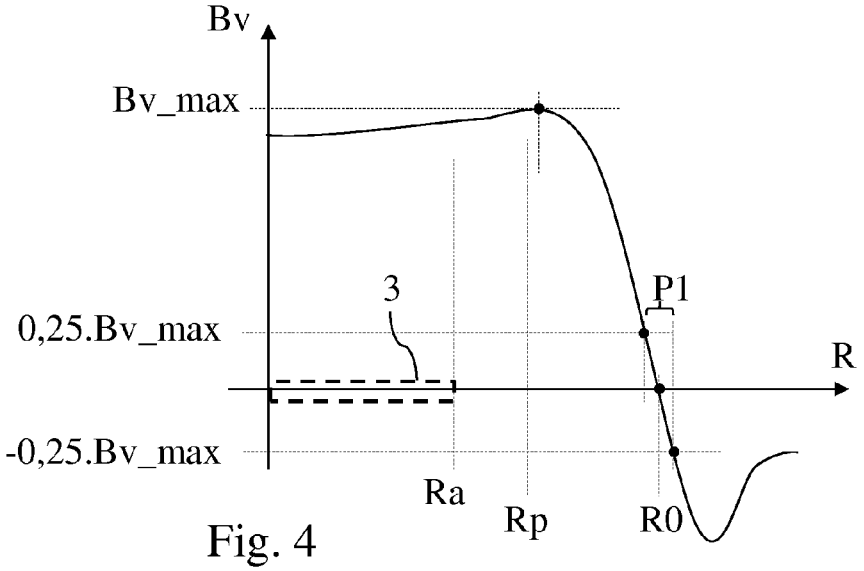
FIG. 4 shows a radial profile of the magnitude of the axial component of the main magnetic field of the cyclotron of FIG. 1 in its median plane and at a first azimuth.

FIG. 4 shows a radial profile of the magnitude By of the axial component ($\vec{Bv}$) of the main magnetic field) in the median plane ($\vec{B}$) at a first azimuth. Such a profile can be obtained by modelling and simulation techniques which are well known to the skilled person. One can for example use a 2D or 3D finite element electro-magnetic modelling and simulation tool such as the "OPERA" ® software tool from the firm COBHAM for example. This profile can also be obtained by a magnetic field measurement technique such as will be described in more detail hereafter.

Knowing this profile, or at least a part of this profile, one selects a value of By which (in absolute value) is smaller than 25% (preferably smaller than 10%, more preferably smaller than 5%, even more preferably smaller than 1%) of a maximum magnitude of the axial component of the main magnetic field at said first azimuth (Bv_max) , and, based on said profile, one determines the first position as being the radial position corresponding to said value of By [step c)]. FIG. 4 shows a range (P1) of possible first positions.

As one can see on this figure, the first position will therefore be located close to a radial position RO where By equals zero.

Preferably, the first position is determined as being the radial position where By equals zero (plus or minus a measurement accuracy of course).

As a consequence, the first position will generally (but not necessarily) be at a radial distance from the central axis (Z) which roughly corresponds to an average radius of the main coil assembly (30, 31).

A magnetic field sensor (40), such as a Hall probe for instance, is then placed at the determined first position in the median plane (M) at said first azimuth and is spatially oriented in order to detect a radial component ($\overrightarrow{Bh}$) of the main magnetic field, i.e. the component of the main magnetic field which is parallel to the median plane (M) [step d)]. In case the magnetic field sensor (40) is a Hall sensor for example, its sensitive surface is oriented obliquely to the median plane (M), preferably perpendicularly to the median plane (M), as shown on FIG. 3.

Next (or, if needed for stabilisation purposes for instance, before one of the previous steps), power is applied to the main coils (30, 31) in order to excite them [step b)]. It is to be noted that either the full nominal power or only a part of the full nominal power may be applied to the main coils at this step.

Then, the magnitude of the radial component ($\overrightarrow{Bh}$) of the main magnetic field is measured with the magnetic field sensor (40), thereby yielding a first measured value Bh1 [step e)].

Next, the position of the main coil assembly (30, 31) with respect to the median plane (M) is adjusted by using the first positioning means (35*v*) and so as to reduce the absolute value of Bh1 [step f)]. The first positioning means (35*v*) may for example comprise a plurality of axial (in this example vertical) support links as described hereinabove, two of these being visible on FIG. 1.

Preferably, the same measurement of the magnitude of the radial component ($\overrightarrow{Bh}$) of the main magnetic field is repeated and the position of the main coil assembly (30, 31) with respect to the median plane (M) is adjusted until the absolute value of Bh1 reaches a minimum.

In order to determine the first position, one preferably proceeds as follows. First, a magnetic field sensor (40), such as Hall probe for instance, is placed anywhere in the median plane (M) at a first azimuth, preferably in the particle acceleration region (3), and it is oriented in order to detect a magnitude of the axial component ($\overrightarrow{Bv}$) of the main magnetic field. In case of a Hall sensor for example, its sensitive surface is therefore oriented substantially parallel to the median plane (M), preferably parallel to the median plane (M) itself and more preferably in the median plane (M) itself.

After applying power to the main coils (30, 31) to excite them, one measures the magnitude of the axial component ($\overrightarrow{Bv}$) of the main magnetic field with the magnetic field sensor (40) at different radial positions at said first azimuth. One therefore obtains a radial profile of the magnitude By of the axial component of the main magnetic field at said first azimuth, as shown on FIG. 4 for example. It is to be noted that doesn't need to obtain the full radial profile of the magnitude of the axial component of the main magnetic field but only that part of said profile which is necessary to find the first position. This part is generally close to the radial position where By crosses zero.

One then easily determines the first position as explained hereinabove.

Preferably, the aforementioned steps c), d), e) and f) are further performed at a second azimuth in the median plane (M), said at least a second azimuth being different from said first azimuth. Furthermore, instead of repeating step c) for the second azimuth, one may alternatively take the value of the first position obtained for the first azimuth and place the magnetic field sensor (40) at the same value of the first position when performing step d) for the second azimuth.

More preferably, the aforementioned steps c), d), e) and f) are further performed at a third azimuth in the median plane (M), said second and third azimuths being different from each other and from the first azimuth. Furthermore, instead of repeating step c) for the third azimuth, one may alternatively take the value of the first position obtained for the first azimuth and place the magnetic field sensor (40) at the same value of the first position when performing step d) for the third azimuth.

In a concrete case of a synchrocyclotron using superconducting coils for generating the main magnetic field, one will for example have the following values of the parameters shown on FIG. 4 :

*Bv*_max=5 Tesla (of which 2 Tesla is due to the iron of the magnetic core and 3 Tesla is due to the coils)

Ra=45 cm
Rp=50 cm
R0=75 cm
P1=20 cm

SECOND METHOD

A main purpose of this second method is to better centre the main coil assembly (30, 31) with respect to the central axis (Z) of the cyclotron (1), i.e. to adjust the lateral position of the main coil assembly (30, 31) with respect to said central axis (Z).

One firstly provides a cyclotron (1) as described hereinabove for the first method and further comprising second positioning means (35*h*) which are adapted to adjust a lateral position of the main coil assembly (30, 31) with respect to the central axis (Z) [step a)].

Next, power is applied to the main coils of the main coil assembly (30, 31) in order to excite them [step b)]. It is to be noted that either the full nominal power or only a part of the full nominal power may be applied to the main coils at this step.

Then, one selects a first plane (A) parallel to the median plane (M) and considers, in said first plane (A), a polar coordinate system having as origin the intersection between the central axis (Z) and the first plane (A), and any axis as polar axis [step c)].

On then selects a first azimuth (a1) in said first plane (A) and determines a first radius (R1*a*) outside the acceleration region (3), at which an axial component ($\overrightarrow{Bv}$) of the main magnetic field, which is the component perpendicular to the median plane (M), has a first magnitude (Bv1*a*) comprised between a minimum (Bv1_min) and a maximum (Bv1_max) magnitude of said axial component of the main magnetic field at said first azimuth [step d)].

Figure 5:
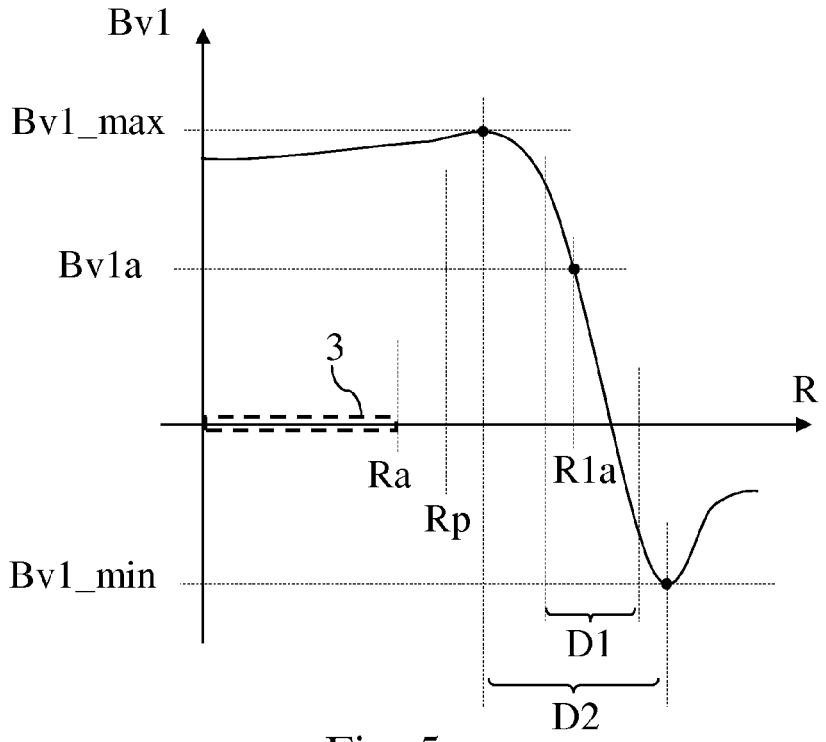
FIG. 5 shows a radial profile of the magnitude of the axial component of the main magnetic field of the cyclotron of FIG. 1 in a first plane parallel to the median plane and at a first azimuth.

Preferably, the first radius (R1*a*) is chosen in a radial region (D1) which is narrower than the radial region (D2) defined by Bv1_min and Bv1_max , as indicated on FIG. 5, because, in such narrower radial region (D2), dBv1/dR is larger than in radial regions closer to radiuses corresponding to Bv1_min or to Bv1_max, which contributes to increasing the sensitivity and the accuracy of the second method.

Determining said first radius (R1*a*) may be performed by known modelling and simulation techniques or by placing a magnetic field sensor, such as a Hall sensor for instance, in the first plane (A) at said first azimuth and outside the acceleration region, by orienting said sensor so that it detects the axial component ($\overrightarrow{Bv}$) of the main magnetic field, and by measuring the amplitude of said axial component of the main magnetic field at different radiuses along said first azimuth until finding its minimum and maximum values and at least an intermediate value.

FIG. 5 shows for example a radial profile obtained by measurement of the magnitude Bv1 of the axial component of the main magnetic field of the cyclotron (1) of FIG. 1 in its median plane (M) and at a first azimuth (α1). An exemplary first magnitude Bv1*a* is shown which is comprised between Bv1_min and Bv1_max, and which corresponds to a first radius R1*a*.

On then repeats step d) at a second azimuth (α2) and at a third azimuth (α3), thereby yielding respectively a second radius (R2*a*) and a third radius (R3*a*) corresponding to respectively to a second magnitude (Bv2*a*) and a third magnitude (Bv3*a*) of the axial component of the main magnetic field [step e)].

In case a magnetic field sensor is used to determine the first radius, the repetition of step d) may be performed each time with the same sensor or simultaneously with three different sensors placed respectively at the first-, second- and third azimuths.

Figure 6:
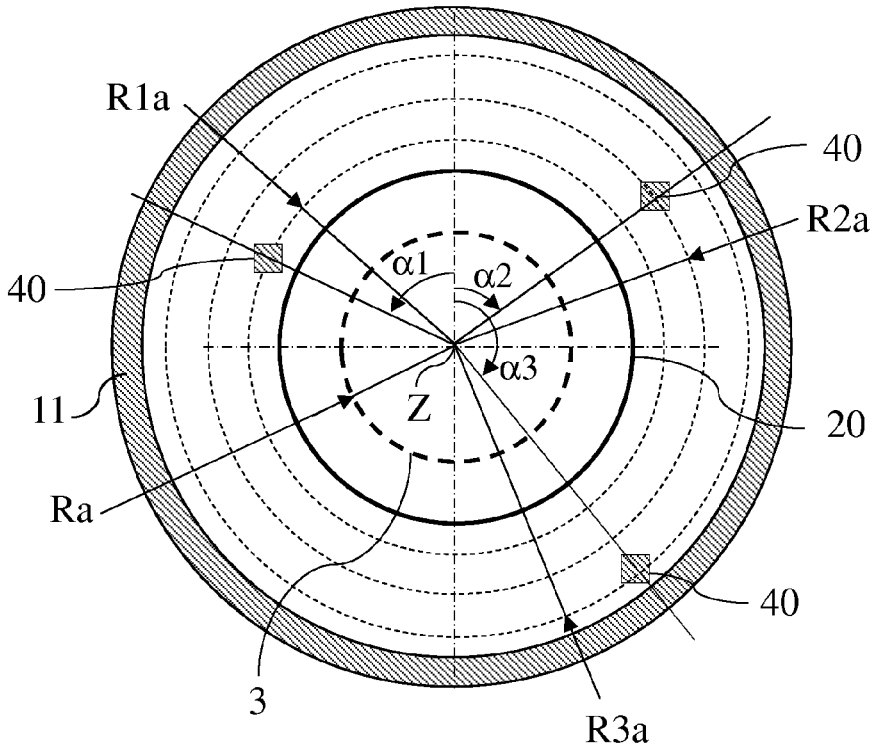
FIG. 6 schematically shows a cross section of the cyclotron of FIG. 1 according to the first plane as well as exemplary positions of magnetic field sensors.

FIG. 6 schematically shows a cross section of the cyclotron (1) of FIG. 1 according to the first plane (A) as well as exemplary radiuses (R1*a*, R2*a*, R3*a*) as determined after performing steps d) and e) with a magnetic field sensor (40) at respectively three different azimuths (α1, α2, α3).

One then adjusts the lateral position of the main coil assembly (30, 31) with respect to the central axis (Z) by using the second positioning means (35*h*) and in function of the values of R1*a*, R2*a*, R3*a*, Bv1*a*, Bv2*a*, Bv3*a* [step f)].

In said step f), an amount of adjustment of the lateral position of the main coil assembly (30, 31) is preferably calculated on the basis of an electro-magnetic model of the main coil assembly and on the values of R1*a*, R2*a*, R3*a*, Bv1*a*, Bv2*a*, Bv3*a*. to this end, one can for example use a 2D or 3D finite element electro-magnetic modelling and simulation tool such as the "OPERA" ® software tool from the firm COBHAM for example.

The adjustment of the lateral position of the main coil assembly preferably comprises a translation of the main coil assembly (30, 31) in a direction parallel to the median plane (M), which can be easily performed by using for example second positioning means (35*h*) which are mounted parallel to the median plane (M), as shown on FIG. 1.

As an example, one may select three azimuths (α1, α2, α3) such that α3=α2+90°=α1180°. In such a case, one may for example select that Bv1*a* =Bv2*a* =Bv3*a* and determine (for example measure) corresponding three radiuses R1*a*, R2*a* and R3*a* after executing steps d) and e). If one finds that R1*a*=R2*a*=R3*a*, then the main coil assembly (30, 31) is centred with respect to the central axis (Z) and there is no need to adjust its lateral position. Else, its lateral position may for example be adjusted so as to minimize the differences between R1*a*, R2*a* and R3*a*.

As another example, one may also select any three different azimuths, select that R1*a*=R2*a* =R3*a*, and determine (for example measure) the corresponding three magnitudes Bv1*a*, Bv2*a*, and Bv3*a*. If it comes out that Bv1*a*=Bv2*a*=Bv3*a*, then the main coil assembly (30, 31) is centred with respect to the central axis (Z) and there is no need to adjust its lateral position. Else, its lateral position may for example be adjusted so as to minimize the differences between Bv1*a*, Bv2*a*, and Bv3*a*.

As will be apparent for the skilled person, many other combinations are possible without departing from the scope of the present invention.

In case the magnetic circuit (11, 20, 21) presents asymmetries, corrections are preferably made to the radial profiles of the magnitudes of the axial component of the main magnetic field at each azimuth, so that only those parts of the magnitudes of the axial component of the main magnetic field which are due to the main coil assembly (30, 31) are taken into account when performing steps d) and e).

Preferably, the first plane (A) is close to the median plane (M).

More preferably, the first plane (A) is the median plane (M) itself. Preferably, Bv1*a*=Bv2*a*=Bv3*a*.

Preferably, the lateral position of the main coil assembly (30, 31) with respect to the central axis (Z) is adjusted so as to minimize the differences between R1*a*, R2*a* and R3*a*.

In a concrete case of a synchrocyclotron using superconducting coils for generating the main magnetic field, one will for example have the following values of the parameters shown on FIG. 5:

*Bv*1_max=5 Tesla (of which 2 Tesla is due to the iron of the magnetic core and 3 Tesla is due to the coils)

Bv1min=−0.5 Tesla
Bv1*a*=2.5 Tesla
Ra=45 cm
Rp=50 cm
R1*a*=60 cm
D1=30 cm
D2=50 cm The first and the second method may be used independently from each other. The first method may be used before or after the second method or simultaneously or in an alternating fashion with the second method. Preferably, the first method is used before the second method is used.

Preferably, the main coil assembly (30, 31) comprises at least a first coil (30) at one side of the median plane (M) and at least a second coil (31) at an opposite side of the median plane (M), as shown on FIG. 1 for example. Even more preferably, said coils (30, 31) are mechanically linked together and the first and/or second positioning means (35*h*) are adapted to move the main coil assembly (30, 31) with respect to the median plane (M) and/or with respect to the central axis (Z).

Preferably, the main coil assembly (30, 31) comprises at least one superconducting coil.

The present invention has been described in terms of specific embodiments, which are illustrative of the invention and not to be construed as limiting. More generally, it will be appreciated by persons skilled in the art that the present invention is not limited by what has been particularly shown and/or described hereinabove.

Reference numerals in the claims do not limit their protective scope. Use of the verbs "to comprise", "to include", "to be composed of", or any other variant, as well as their respective conjugations, does not exclude the presence of elements other than those stated.

Use of the article "a", "an" or "the" preceding an element does not exclude the presence of a plurality of such elements.

The invention may also be described as follows: methods for adjusting the position of a main coil assembly (30, 31) in a cyclotron (1) with respect to a median plane (M) and/or to a central axis (Z) of the cyclotron.

According to a first method, a measurement is made of the magnitude of a radial component ($\overrightarrow{Bh}$) of the main magnetic field ($\vec{B}$), at at least a first azimuth and at at least a first position (P1) in the median plane and outside the particle acceleration region (3) at which the magnitude (Bv) of an axial component ($\vec{Bv}$) of the main magnetic field ($\vec{B}$) is substantially smaller than a maximum magnitude (Bv_max) of the axial component of the main magnetic field at said first azimuth. The position of the main coil assembly (30, 31) with respect to the median plane (M) is then adjusted so as to reduce, preferably to minimize the magnitude of said radial component of the main magnetic field at said at least a first position.

According to a second method, three radial positions (R1*a*, R2*a*, R3*a*) with respect to the central axis (Z) are determined at respectively three azimuths ($\alpha$1, $\alpha$2, $\alpha$3) in a plane (A) parallel to the median plane (M) and at which the three magnitudes (Bv1*a*, Bv2*a*, Bv3*a*) of the axial component ($\vec{Bv}$) of the main magnetic field ($\vec{B}$)are respectively comprised between a minimum and a maximum magnitude of said axial component of the main magnetic field at respectively each said three azimuths.

The lateral position of the main coil assembly (30, 31) with respect to the central axis (Z) is then adjusted in function of said three radial positions (R1*a*, R2*a*, R3*a*) and said three magnitudes (Bv1*a*, Bv2*a*, Bv3*a*).

Contrary to the prior art methods, the two methods according to the invention propose to adjust the position of the main coil assembly in function of magnetic field measurements or determinations which are performed radially outside of the particle acceleration region.

What is claimed is:

1. A method for adjusting the position of a main coil assembly in a cyclotron with respect to a reference plane, said method comprising the steps of:

a) providing a cyclotron designed for accelerating charged particles in a particle acceleration region of a median plane of the cyclotron, said cyclotron comprising a main coil assembly designed to generate a main magnetic field ($\vec{B}$) for bending a trajectory of the charged particles in the acceleration region and first positioning means which are adapted to adjust a position of said main coil assembly with respect to said median plane;

b) applying power to the main coil assembly;

c) determining a first position (P1), at a first azimuth in the median plane and outside the particle acceleration region, at which the magnitude (Bv) of an axial component ($\vec{Bv}$) of the main magnetic field perpendicular to the median plane is smaller than 25% of a maximum magnitude (Bv_max) of the axial component of the main magnetic field at said first azimuth;

d) placing a magnetic field sensor at the first position (P1) and orienting it in order to detect a radial component ($\vec{Bh}$) of the main magnetic field parallel to the median plane;

e) measuring the magnitude of said radial component of the main magnetic field with the magnetic field sensor, thereby yielding a first measured value Bh1; and f) adjusting the position of the main coil assembly with respect to the median plane by using the first positioning means so as to reduce the absolute value of Bh1.

2. The method of claim 1, wherein the steps e) and f) are repeated until the absolute value of Bh1 reaches a minimum.

3. The method of claim 1, wherein the step c) comprises the steps of:

c1) placing a magnetic field sensor at a position in the median plane having the first azimuth and in order to detect the axial component ($\vec{Bv}$) of the main magnetic field;

c2) measuring the magnitude (Bv) of said axial component of the main magnetic field with the magnetic field sensor;

c3) repeating the steps c1) and c2) at different positions in the median plane having said first azimuth; and c4) determining the first position (P1) as being a position of the magnetic field sensor where the measured magnitude of the axial component of the main magnetic field is smaller than 25% of a maximum magnitude (Bv_max) of the axial component of the main magnetic field at said first azimuth.

4. The method of claim 1, wherein the steps c), d), e) and f) are further performed at a second azimuth in the median plane.

5. The method of claim 4, wherein the steps c), d), e) and f) are further performed at a third azimuth in the median plane.

6. The method of claim 1, wherein the main coil assembly comprises at least a first coil at one side of the median plane and at least a second coil at an opposite side of the median plane.

7. The method of claim 1, wherein the main coil assembly comprises at least one superconducting coil.

8. A method for adjusting a lateral position of a main coil assembly in a cyclotron with respect to a reference axis, said method comprising the steps of:

a) providing a cyclotron designed for accelerating charged particles in a particle acceleration region of a median plane of the cyclotron, a central axis of the cyclotron being perpendicular to said median plane, said cyclotron comprising a main coil assembly designed to generate a main magnetic field ($\vec{B}$) for bending a trajectory of the charged particles in the acceleration region and second positioning means which are adapted to adjust a lateral position of said main coil assembly with respect to said central axis;

b) applying power to the main coil assembly;

c) selecting a first plane parallel to the median plane and considering, in said first plane, a polar coordinate system having as origin the intersection between the central axis and the first plane;

d) determining, in said first plane and at a first azimuth ($\alpha$1), a first radius (R1*a*) outside the acceleration region and at which an axial component ($\vec{Bv}$) of the main magnetic field perpendicular to the median plane has a first magnitude (Bv1*a*) comprised between a minimum (Bv1_min) and a maximum (Bv1_max) magnitude of said axial component of the main magnetic field at said first azimuth;

e) repeating step d) at a second azimuth ($\alpha$2) and at a third azimuth ($\alpha$3), thereby yielding respectively a second radius (R2*a*) and a third radius (R3*a*) corresponding to respectively to a second magnitude (Bv2*a*) and a third magnitude (Bv3*a*) of the axial component of the main magnetic field; and f) adjusting the lateral position of the main coil assembly with respect to the central axis by using the second positioning means and in function of the values of R1*a*, R2*a*, R3*a*, Bv1*a*, Bv2*a*, Bv3*a*.

9. The method of claim 8, wherein ,in step f), an amount of adjustment of the lateral position of the main coil assembly is calculated on the basis of an electro-magnetic model of the main coil assembly and on the values of R1*a*, R2*a*, R3*a*, Bv1*a*, Bv2*a*, Bv3*a*.

10. The method of claim 8, wherein the first (Bv1*a*), the second (Bv2*a*), and the third (Bv3*a*) magnitudes are those parts of the magnitudes of the axial component (Dv) of the main magnetic field which are due to the main coil assembly only.

11. The method of claim 8, wherein the first plane is the median plane.

12. The method of claim 8, wherein Bv1*a*=Bv2*a*=Bv3*a*.

13. The method of claim 8, wherein, in step f), the lateral position of the main coil assembly with respect to the central axis is adjusted so as to minimize the differences between R1*a*, R2*a* and R3*a*.

14. The method of claim 8, wherein the main coil assembly comprises at least a first coil at one side of the median plane and at least a second coil at an opposite side of the median plane.

15. The method of claim 8, wherein the main coil assembly comprises at least one superconducting coil.

* * * * *